US005329790A

United States Patent [19]

Engelfried et al.

[11] Patent Number: 5,329,790

[45] Date of Patent: Jul. 19, 1994

[54] KNITTING MACHINE

[75] Inventors: Werner Engelfried, Sindelfingen; Gerhard Müller, Esslingen 1, both of Fed. Rep. of Germany

[73] Assignee: Terrot Strickmaschinen GmbH, Stuttgart, Fed. Rep. of Germany

[21] Appl. No.: 57,090

[22] Filed: May 4, 1993

[30] Foreign Application Priority Data

May 26, 1992 [DE] Fed. Rep. of Germany ..... 4217419

[51] Int. Cl.[5] ..... D04B 15/68

[52] U.S. Cl. ..... 66/221; 66/219; 66/222

[58] Field of Search ..... 66/215, 219, 220, 221, 66/222, 223

[56] References Cited

U.S. PATENT DOCUMENTS 4,838,048 6/1989 Müller et al. ..... 66/220
4,989,425 2/1991 Furia ..... 66/221 X
5,138,850 8/1992 Müller et al. ..... 66/223 X

*Primary Examiner*—Clifford D. Crowder
*Assistant Examiner*—John J. Calvert
*Attorney, Agent, or Firm*—Shenier & O'Connor

[57] ABSTRACT

A knitting machine comprises a needle cylinder, stitch-forming knitting needles, displaceable selector elements for initiating specific knitting operations, springs which bias the selector elements into a first position, mechanical control means which transfer the selector elements into a second position contrary to their biasing and electromagnetic selector means which comprise at least one activatable magnetic pole for holding the selector elements in their second position. The displaceable selector elements have a stop edge which cooperates in the second position with a counterstop edge stationary relative to the movement of the selector element. When the stop edge engages on the counterstop edge, the selector elements are located at such a small distance from the electromagnetic selector means, hereby forming an air gap, that their magnetic force is still sufficient to hold the selector elements in their second position.

9 Claims, 7 Drawing Sheets

KNITTING MACHINE

The invention relates to a knitting machine comprising stitch-forming knitting needles mounted in a rotatingly driven needle cylinder, displaceable selector elements for initiating specific knitting operations, springs biasing the selector elements into a first position, mechanical control means for transferring the selector elements into a second position contrary to their biasing and electromagnetic selector means comprising at least one activatable magnetic pole for holding the selector elements in their second position.

In known knitting machines of this type (DE 40 27 379 C1), the selector elements, in their second position, rub constantly against the electromagnetic selector means. Due to the prevailing, relatively high magnetic force of attraction, this results in considerable friction and wear and tear between the surfaces of the electromagnetic selector means and the selector elements which abut on one another and, therefore, these parts do not have a high service life. It has already been suggested to make the surfaces which rub against one another from hard metal or the like, which does, however, entail high manufacturing costs. Moreover, interruptions in the operation of the knitting machine can occur because the selector elements often adhere or "stick" to the magnetic selector means due to the prevailing magnetic field and can no longer be returned into their first or initial position by their biasing springs.

The object of the invention is to remedy the faults as described and design a generic knitting machine such that the selector elements are held in their second position in relation to the electromagnetic selector means such that there is no friction or wear and tear and they can be reliably transferred into their first positions.

The object is accomplished in accordance with the invention, in a generic knitting machine, in that the displaceable selector elements have a stop cooperating in the second position with a counterstop which is stationary relative to the movement of the selector element, and that when the stop abuts on the counterstop the selector elements are located at such a small distance from the electromagnetic selector means, hereby forming a gap, that their magnetic force is still sufficient to hold the selector elements in their second position.

In accordance with the invent/on, a "non-contact magnetic connection" is, so to speak, suggested for a generic knitting machine.

The following description of a preferred embodiment of the invention serves to explain the invention in greater detail in conjunction with the attached drawings. In these drawings.

Figure 1:
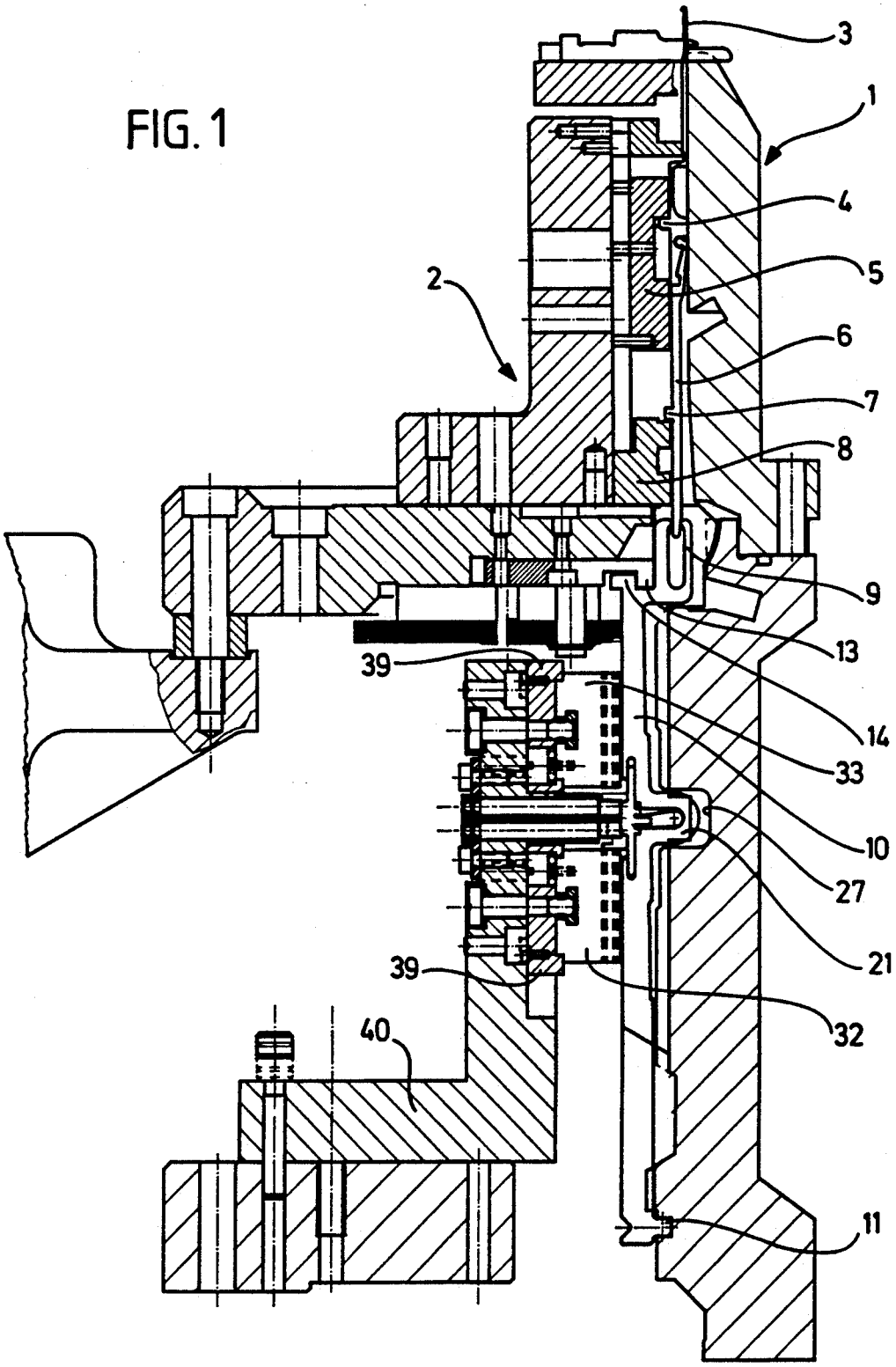
FIG. 1 is a schematic view of an axial part-section of a circular knitting machine.

The circular knitting machine illustrated schematically and only partially in FIG. 1 comprises in the customary manner a rotatably mounted needle cylinder 1 which is surrounded by a stationary cam ring 2 consisting of several parts. Knitting needles 3 are mounted in the customary manner for axial sliding displacement on the outer side of the needle cylinder 1 in longitudinal slots arranged next to one another. Each knitting needle 3 comprises a control foot 4 interacting with a cam part to bring about the downward movement of the knitting needle 3. Each knitting needle 3 is connected at its lower end in a conventional manner with a pusher means 6 comprising a control foot 7. This control foot 7 interacts with a cam part 8 which triggers the upwardly oriented, drive-out movement of the pusher means 6 and the knitting needle 3 connected therewith. The lower end of the pusher means 6 is accommodated for axial sliding displacement in a fork-like claw 9 of a pattern bar 10 which is pivotally mounted at its lower end in a groove of the needle cylinder 1 by means of a projection 11.

When the pattern bar 10 is pivoted to the right in the clockwise direction about the projection 11 acting as a pivot axis, out of its position illustrated to the left in FIG. 1, the pusher means 6 is taken along so that its control foot 7 is disengaged from the cam part 8 and, therefore, the upward movement of pusher means 6 and knitting needle 3 is prevented or interrupted. The knitting needle 3 therefore remains in a specific position in relation to the needle cylinder 1 and is then later returned to the initial position again by the cam part 5 engaging on the control foot 4. In this way, any desired knitting patterns (multicoloured patterns or knitting combinations) can be produced in a manner known per se by correspondingly controlling the pattern bars 10.

An eccentric return means 13 rigidly connected to the cam ring 2 cooperates with a control foot 14 on the pattern bar 10 and can return the pattern bar 10 in a manner known per se to the initial position illustrated to the left in FIG. 1.

Figure 2:
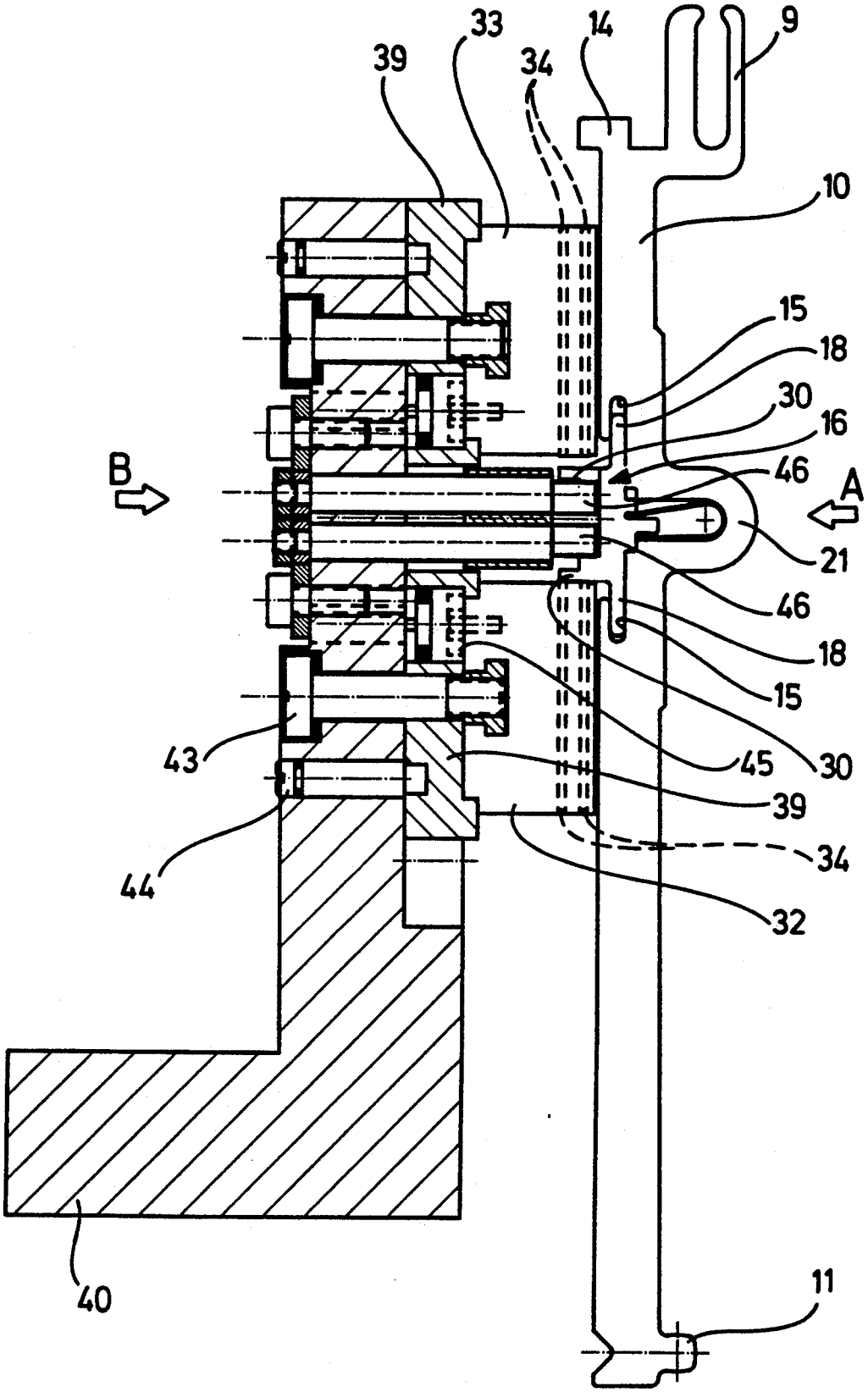
FIG. 2 is an enlarged partial view from FIG. 1.
Figure 3:
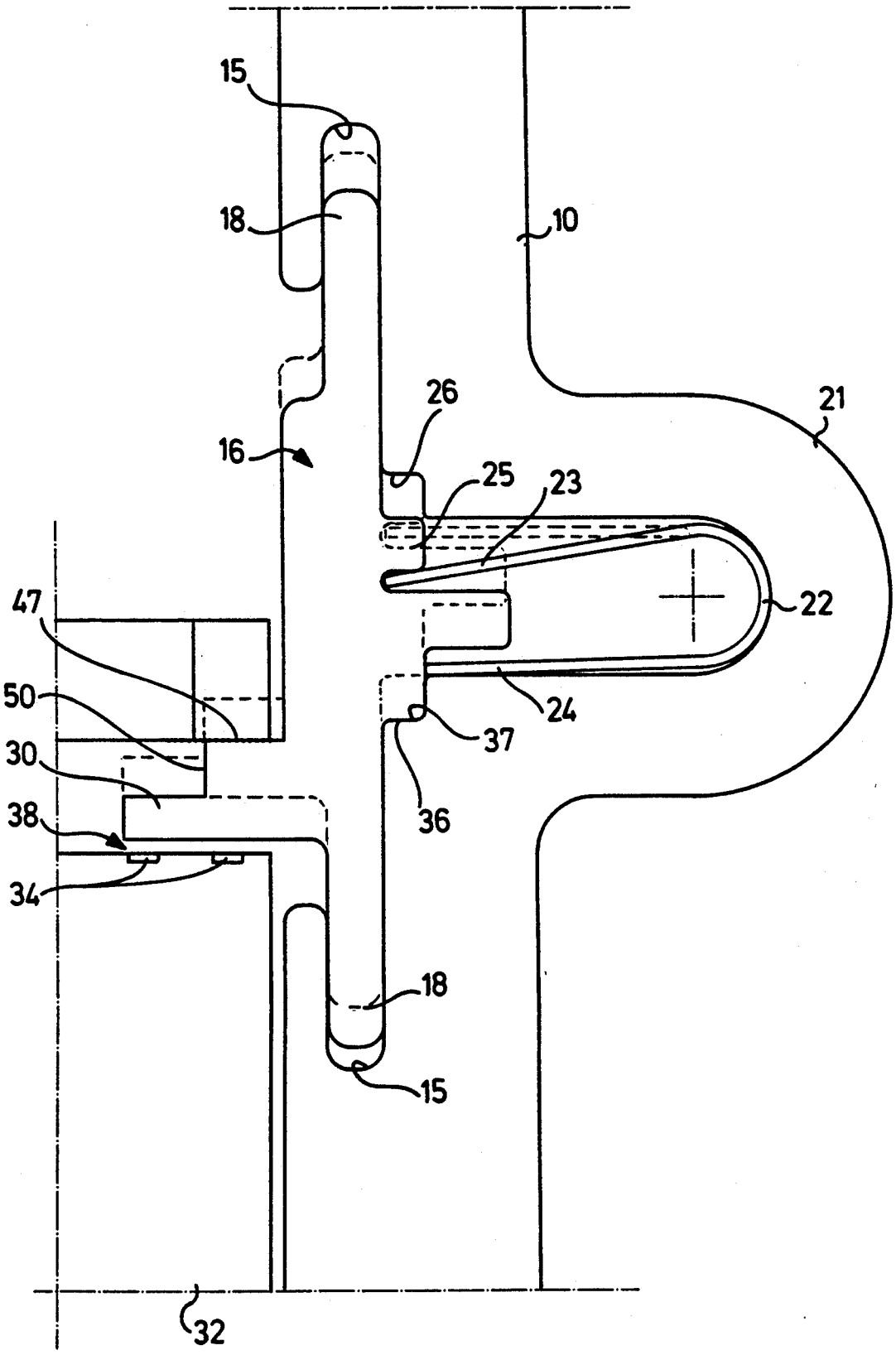
FIG. 3 is a further enlarged partial view from FIG. 2.

As best seen from the enlarged views of FIGS. 2 and 3, a selector element 16 is mounted in superposed, axially or vertically extending slots 15 in the pattern bar 10 for sliding displacement in the longitudinal direction of the pattern bar 10. For this purpose, the selector element 16 engages in the slots 15 of the pattern bar 10 with two arms 18 projecting axially from it in opposite directions. This ensures a sliding guidance of the selector element 16 without jamming.

The pattern bar 10 comprises in the region of the selector element 16 a bulge 21 directed towards the axis of rotation of the needle cylinder 1. A U-shaped spring 22 having two free arms 23, 24 is arranged in this bulge and is designed such that, normally, the free ends of the arms 23, 24 are biased apart from one another. The free end of the arm 23 engages in a notch of the selector element 16. The free end of the arm 24 is supported in the region of the bulge 21 on the pattern bar 10 such that, normally, the selector element 16 is displaced upwards in FIG. 3 into a first position by the spring 22 and held in this position. In this first position, a projection 25 of the selector element can abut on the upper edge 26 of a recess in the pattern bar 10. The bulge 21 of the pattern bar 10, which accommodates the spring 22, is itself accommodated by a corresponding groove 27 in the needle cylinder 1 (cf. FIG. 1) so as to be freely movable in a radial direction. Instead of a spring 22 shaped like a stirrup, other springs which act in the same manner, e.g. bar, torsion or helical springs and the like, could be used.

In FIGS. 1, 2 and 3, additional pattern bars are located in the needle cylinder 1 behind the illustrated pattern bar 10. The bulges 21 of these additional pattern bars all engage in the groove 27 of the needle cylinder 1. A selector element 16 is arranged in each of these pattern bars, which occupy the entire circumference of the needle cylinder 1, and is biased by a spring 22 into its first position. In this respect, however, every two selector elements 16 arranged in pattern bars 10 located side by side are arranged in mirror image to one another so that the said first position of the selector element 16 is alternately located at the top or at the bottom in FIG. 3. As shown in FIG. 3, the selector element 16 has a foot or butt 30 protruding to the left. Due to the mirror-image symmetrical arrangement, this foot 30 of the selector element located behind the selector element 16 in FIG. 3 is located at the top, as shown clearly in FIG. 2 by the two reference numerals 30. The two pattern bars 10 located next to one another, with the selector elements 16 which are displaceable in these pattern bars in mirror image to one another, are offset relative to one another by half the spacing of the needles.

As best shown in FIG. 2, electromagnetic selector means 32, 33 cooperate with each selector element 16 in a respective pattern bar 10. The selector means 32 is also indicated in FIG. 3. The electromagnetic selector means 32 engages on the selector element 16 illustrated in FIG. 3. The electromagnetic selector means 33 is, according to FIG. 2, arranged in mirror image above the selector means 32 and engages on that selector element which is located behind the illustrated selector element 16.

Figure 4:
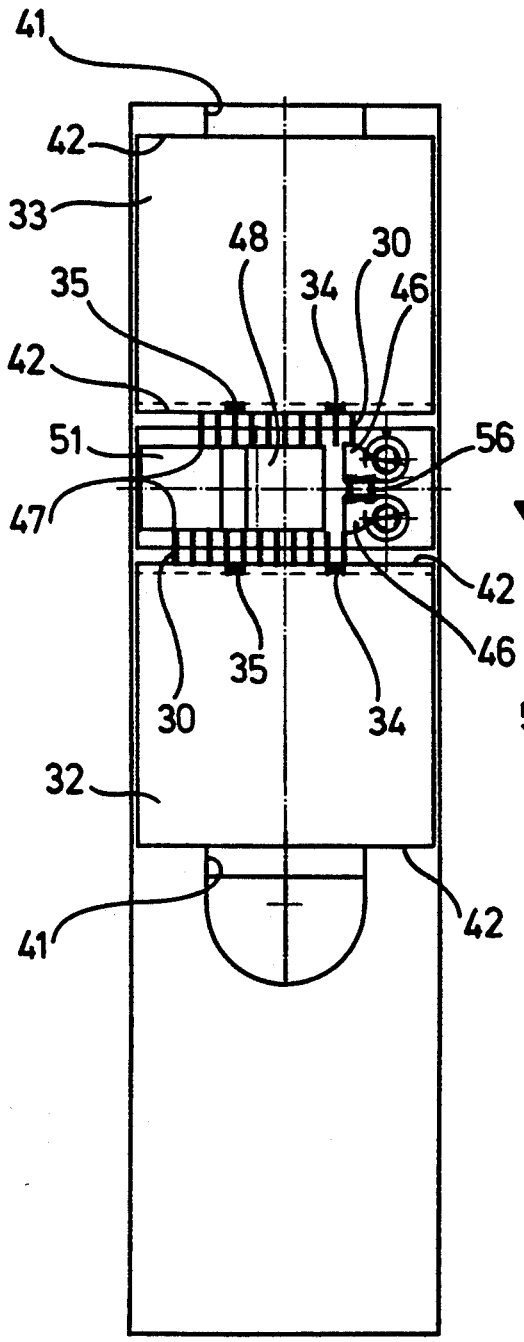
FIG. 4 is a partially schematic view in the direction of arrow A in FIG. 2 with the pattern bars removed.

In the illustrated embodiment, each of the electromagnetic selector means 32, 33 is designed in a manner known per se as a permanent magnet which contains individually activatable electromagnetic poles 34, 35 (cf. also FIG. 4). As shown in FIG. 3, the poles 34 and 35, respectively, can be provided in pairs in a radial direction so that they cover the longitudinal extension of the foot 30 of the selector element 16. Normally, the magnetic poles 34, 35 which lie flush with the free surface of the selector means 32, 33 are not excited and so the selector element 16, which is displaced contrary to the biasing of the spring 22 out of its first position (in FIG. 3 at the bottom) into a second position, is fixed or held in this position due to the effect of the permanent magnet of the electromagnetic selector means 32. If, however, the effect of the permanent magnet is cancelled or neutralized by the correspondingly excited magnetic poles 34 35 the spring 22 can move the selector element 16 out of the second position and back into the first position. The magnetic poles 34, 35 can also be switched such that, on the one hand, they amplify the effect of the said permanent magnet and, on the other hand, alternatively neutralize or at least attenuate this effect. The first position of the selector element 16 to which it is urged by the spring 22 is shown in broken lines in FIG. 3. The full line position shown in the Figure is the second position of the element in which it is held by the permanent magnet of the electromagnetic selector means 32.

Each selector element 16 has (cf. FIG. 3) a stop surface or edge 36 which interacts with a counterstop surface or edge 37 on the pattern bar 10. The second position of the selector element 16 is determined by the stop edge 36 striking on the counterstop edge 37. As illustrated in FIG. 3, the arrangement is such that when the stop edge 36 abuts on the counterstop edge 37, i.e. the selector element 16 is located in its second position, the selector element 16 displaceable in the pattern bar 10 is located at such a small distance from the electromagnetic selector means 32, hereby forming an air gap 38, that its magnetic force is still sufficient to hold the selector element 16 in its second position. In this way, a non-contact magnetic connection results between electromagnetic selector means 32 and selector element 16 and this is adequate, due to corresponding dimensioning of the said permanent magnet, to hold the selector element 16 in the first position contrary to the action of the spring 22. Since, in the case of this non-contact magnetic connection, no friction or wear and tear occurs on the surface of the electromagnetic selector means 32, which lies opposite the foot 30 of the selector element 16, during the rotating movement of the foot 30 past the electromagnetic selector means 32, the arrangement has a considerably longer service life in comparison with the case where the foot 30, in the second position of the selector element 16, constantly rubs with considerable force on the counterface of the stationary, electromagnetic selector means 32, 33.

It has been found that the distance between the electromagnetic selector means 32 and the selector element 16 can be approximately 0.05 mm. Depending on the number of parts and the desired magnetic force, distances of between 0.005 to 0.2 mm, preferably also between 0.01 and 0.1 mm, can be considered.

In order to be able to exactly adjust the width of the air gap 38, i.e. the distance between selector element 16 (its foot and the selector means 32, to achieve a desired non-contact magnetic flow which is as great as possible, the electromagnetic selector means 32 is adjustable relative to the foot 30 of the selector element 16. Alternatively, for achieving the same purpose, the pattern bar 10 or a different component guiding the selector element 16 and comprising a counterstop edge 37 could be designed so as to be adjustable relative to the electromagnetic selector means 32.

In the embodiment illustrated ( cf . FIGS. 2 and 4 ), the magnetic selector means 32—the same also applies for the electromagnetic selector means 33—is rigidly arranged in a guide member 39 which, for its part, is displaceable in corresponding sliding guide means in a cam segment 40 of the cam ring 2, both axially as well as at right angles hereto in a peripheral direction. FIG. 4 indicates for the guide member 39 a sliding guide means 41 extending axially or vertically and a sliding guide means 42 extending peripherally or horizontally. A setscrew 43 (FIG. 2) serves to fix the guide member 39 with the electromagnetic selector means 32 connected thereto in the set position on the cam segment 40. When the screw 43 is released, the guide member 39 can be displaced in a conventional manner, in a vertical direction by means of an eccentric screw 44 and in a horizontal direction by means of an additional eccentric screw 45. In this way, the position of the magnetic selector means 32, 33 and, in particular, the width of the air gap 38 can be exactly adjusted.

In the following, mechanical control means will be described, with the aid of which the selector elements 16 are moved out of their first position defined by the biasing force of the springs 22 and automatically into the second position contrary to the action of these springs. In this second position, the selector elements 16 are held in place by the magnetic force of the electromagnetic selector means 32, 33. These control means each comprise, as shown in FIGS. 2 and 4, a control cam part 46, which is approximately wedge-shaped in the view shown in FIG. 4. An edge 47 on the foot 30 of the selector element 16 runs up against the narrow side of this cam part—coming from the right in FIG. 4—and is subsequently pressed downwards or upwards towards the electromagnetic selector means 32 and 33, respectively, automatically taking along the selector element 16, and the selector element 16 is fixed in its second position by the magnetic force of these means .

When the magnetic force of attraction of the relevant selector means, i.e. 32, is neutralized by corresponding activation of the magnetic pole 34 (FIG. 4), the spring 22 moves the selector element 16 back into its first position. At the same time, its foot 30 reaches the area of a control cam 48 (FIG. 4) which engages on an edge 50 of the control foot 30 on account of an inclined surface 49 designed on this cam and shown in FIG. 6. The control cam hereby moves the selector element 16, together with the entire pattern bar 10, radially inwards (to the right in FIGS. 1–3) so that the control foot 7 of the pusher means 6 (FIG. 1) is disengaged from the cam part 8. This prevents the needle from being driven out and the knitting needle 3 remains in the so-called floating position.

Figure 6:
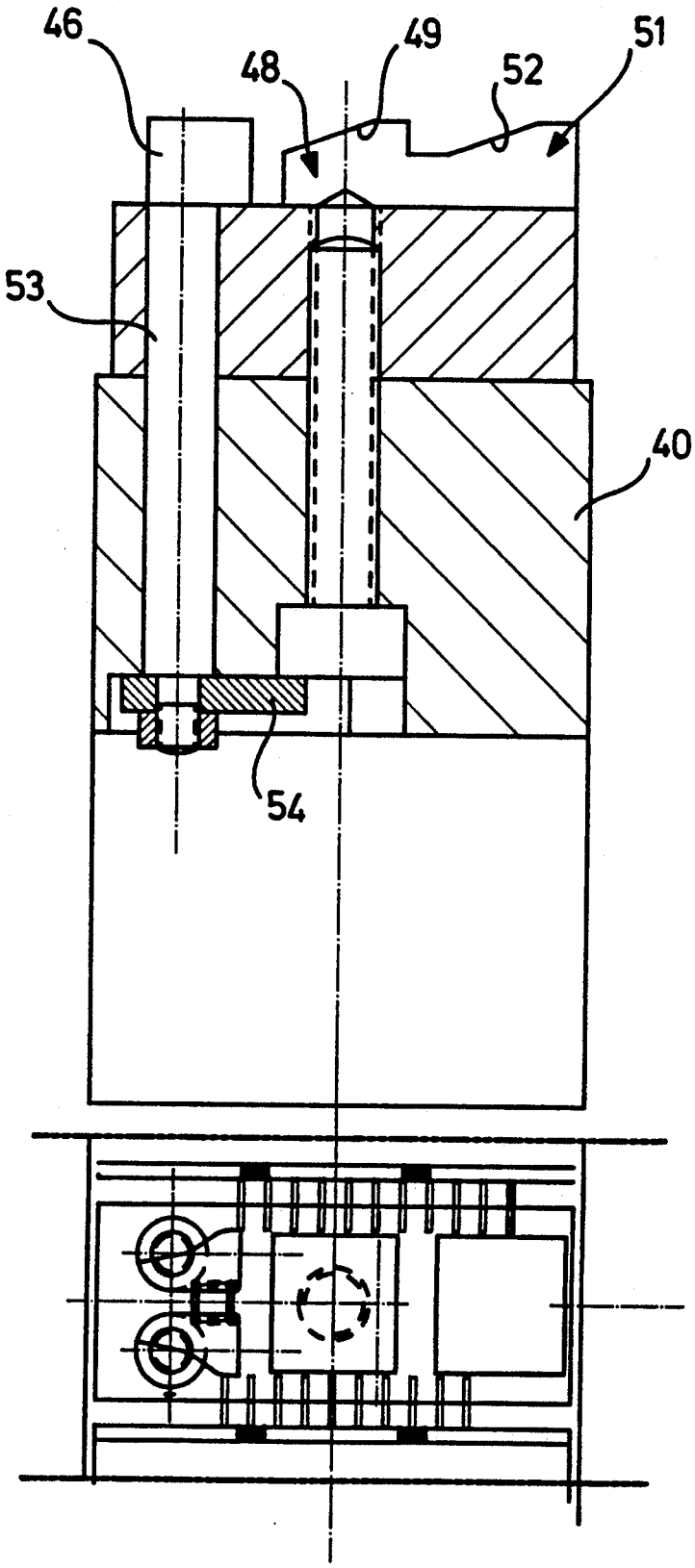
FIG. 6 is a partially schematic sectional view along line 6—6 in FIG. 5.

If it is not the magnetic pole 34 that is activated as the feet 30 of the individual selector elements 16 pass by but, instead and at a somewhat later time, the additional magnetic pole 35 following on from it in a circumferential direction, the control feet 30 reach the effective range of an additional control cam 51, which has an inclined surface 52 corresponding to the inclined surface 49 (FIG. 6). This means that the control foot 7 of the pusher means is again disengaged from the cam part 8, due to pivoting of the pattern bar 10 and with the knitting needle 3, in the meantime, driven out further in an upward direction. This prevents the needle from being driven out further and the knitting needle 3 remains in the so-called tuck position.

If neither of the magnetic poles 34, 35 is activated, the pattern bar 10 is not pivoted at any time and the needle 3 moves into the so-called knitting position.

Figure 5:
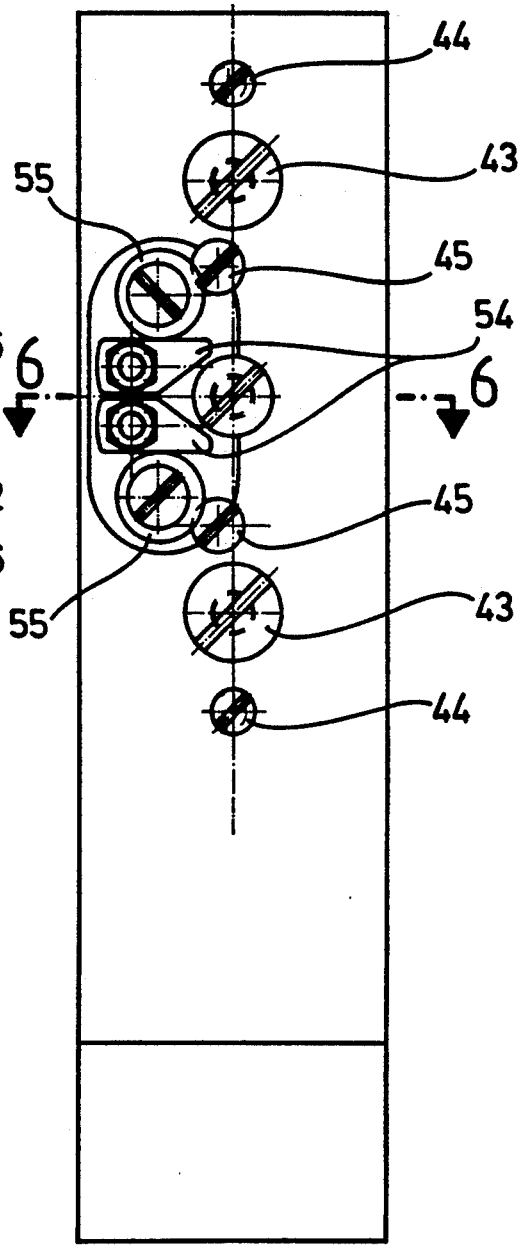
FIG. 5 is a view in the direction of arrow B in FIG. 2.

As best shown in FIGS. 4, 5 and 6, the wedge-shaped control cam parts 46 are each arranged to radially protrude at the end face of bolts 53 which are rotatably mounted in the cam segment 40. Located opposite the control cam part 46, a laterally protruding lug 54 is arranged on the bolt 53 and an adjusting eccentric 55 engages on this lug (cf. FIG. 5). As is apparent from FIG. 4, a pressure spring 56 is arranged between the two superposed control cam parts 46, which are each associated with two adjacent pattern bars 10 and their selector elements 16, such that this pressure spring attempts to press the two wedge-shaped control cam parts 46 apart and hereby presses the flanks of the lugs 54 against the adjusting eccentric 55. The control cam parts 46 are adjusted with the aid of the adjusting eccentric 55 contrary to the action of this pressure spring 56.

In this way, the control cam parts 46 may be adjusted in a defined position but they are still held in this position by the pressure spring 56 in such an elastic manner that the lower control cam part 46 (FIG. 4) can deflect upwardly in an elastic, rotating manner and the upper control cam part 46 downwardly when a foot 30 with its edge 47 (FIG. 3) reaches the effective range of the control cam part 46 and the height of this edge 47 would be too high, when stop edge 36 is already engaged on the counterstop edge 37, to be able to pass beneath the control cam part 46. In this way, the elastically deflecting control cam parts 46 prevent any blocking or even destruction of the assembly. In FIG. 4, the feet 30 of the selector elements 16 passing the control cam parts 46 are indicated with their upper and lower edges 47, respectively.

FIG. 5 also shows the setscrew 43 already mentioned and the eccentric screws 44, 45 which have also been mentioned and with the aid of which the electromagnetic selector means 32, 33 are adjustable via the associated guide parts 39 in two coordinate directions.

FIG. 4 shows how the control feet 30 are offset each time by half the spacing of the needles, along with the lower and upper selector elements 16, respectively, and the pattern bars 10 associated therewith.

A particularly exact activation of the selector elements 16 may be achieved due to this offset arrangement.

In the embodiment described, the selector element 16 is arranged for displacement in a pattern bar 21 and serves to adjust the knitting needles into a knitting, floating and tuck position. The invention may, of course, be used for selector elements of any other type, and generally for magnetically controlled, stitch-forming parts or the like of a knitting machine, when these parts are intended to be magnetically controlled and held in place by a magnetic connection. In any case, it is sufficient to provide a stop 36 on this part which interacts with a counterstop 37 (e.g. on the needle cylinder 1) and merely causes the part to approach the magnetic selector means in a non-contact manner.

Figure 7:
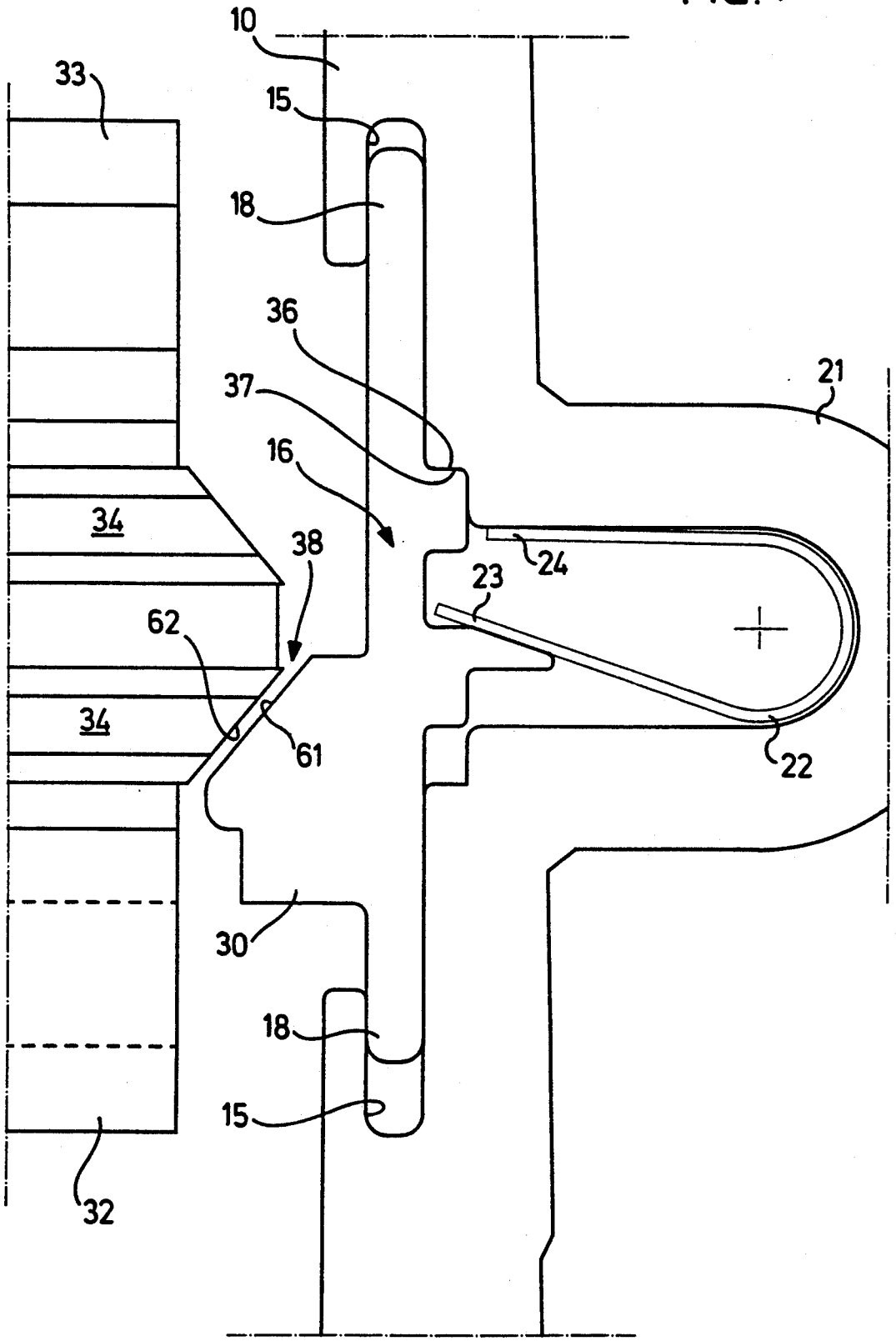
FIG. 7 is a view similar to FIG. 3 of a modified embodiment.

FIG. 7 shows an embodiment which is modified in comparison with FIG. 3. Parts corresponding to one another in the two Figures have been given the same reference numerals.

In FIG. 3, the magnetic poles 34 have horizontally extending surfaces engaging on the horizontal lower edge of the foot 30 of the selector element 16. In contrast hereto, the foot 30 of the selector element 16 in FIG. 7 has an inclined engaging edge 61 which is located opposite an inclined operative surface 62 of the magnetic pole 34 which extends parallel thereto. As a result of this inclined arrangement, a vertically extending force component is also generated which holds the selector element 16 in its second position.

In further contrast to FIG. 3, in FIG. 7 the selector element 16 is designed and the spring 22 arranged such that the second position of the selector element 16 is reached when the latter is displaced upwardly in FIG. 7 (i.e. not downwardly as in FIG. 3). Accordingly, the stop edge 36 and the counterstop edge 37 are also arranged on the selector element 16 and the pattern bar 10, respectively, so as to be upwardly operative.

Figures 8, 9:
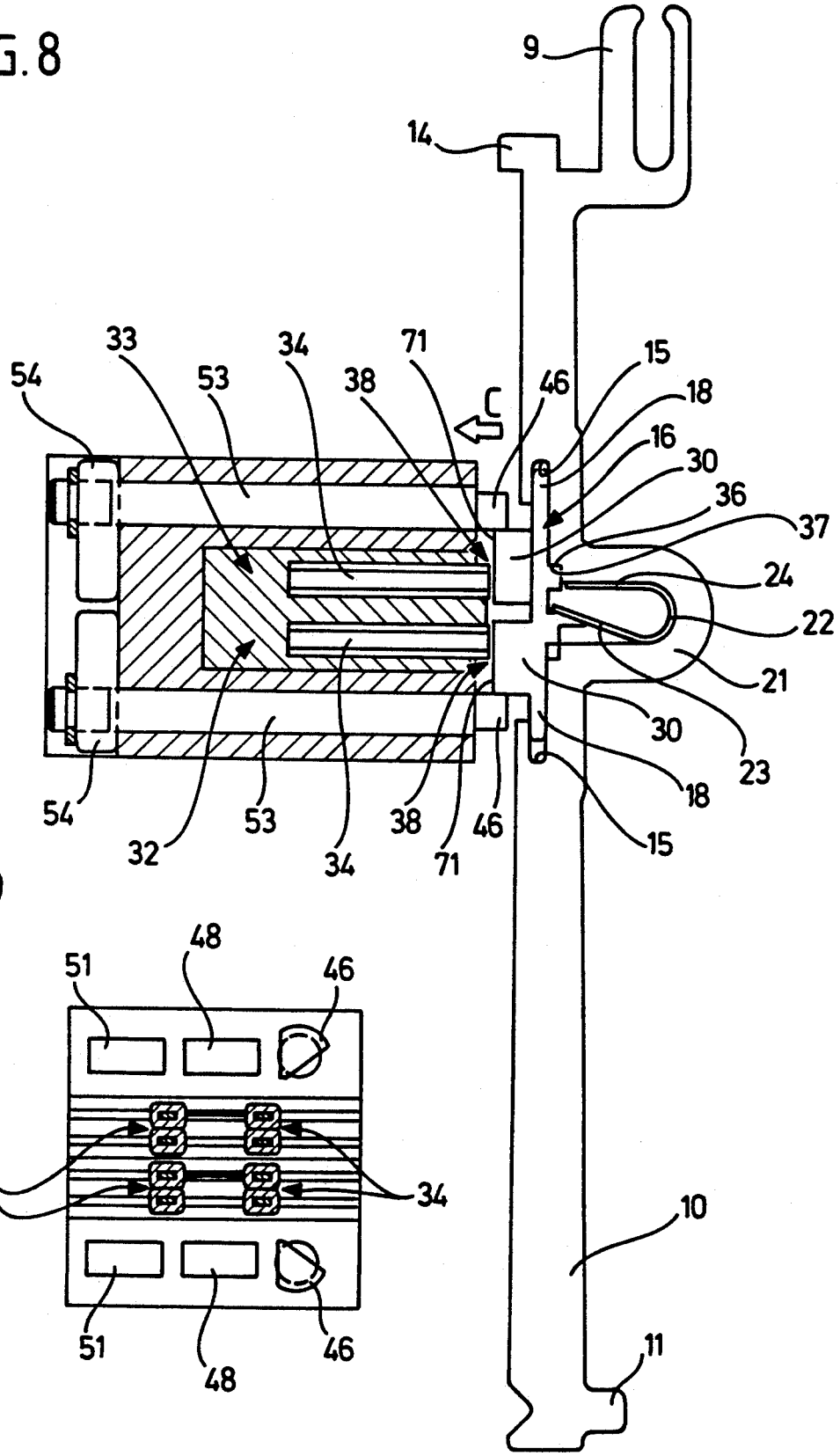
FIG. 8 is a view similar to FIG. 2 of a further modified embodiment.
FIG. 9 is a view in the direction of arrow C in FIG. 8.

FIGS. 8 and 9 show a third embodiment of the invention. In these Figures, parts corresponding to one another have been given the same reference numerals as in FIGS. 1 to 6 and 7 so that, in this respect, reference may be made to the description of these Figures.

In the embodiment of FIGS. 8 and 9, selector elements 16 are again arranged for displacement in pattern bars 10. Each selector element 16 has a stop edge 36 which interacts with a counterstop edge 37 on the pattern bar 10 and determines the second position of the selector element 16. The spring 22, with its arms 23, 24, presses the selector element 16 downwardly into its first position in FIG. 8, in the same manner as in FIG. 7.

The magnetic selector means 32, 33 comprise in a manner known per se activatable electromagnetic poles 34, 35, with the aid of which the selector elements 16, with their feet 30, can be fixed in the second position. In FIG. 8, the illustrated selector element 16 with its foot 30 is fixed in its second, upper position on the lower magnetic pole 34 contrary to the action of the spring 22. The upper magnetic pole 34 is associated with the additional selector element located behind the illustrated selector element 16, the foot 30 of which is visible in FIG. 8.

It is apparent from FIG. 8 that the foot 30 of the selector element 16 has each time a free edge 71 which extends essentially vertically or axially and which is located at a distance, i.e. in a non-contact manner, from the operative surface of the magnetic selector means 32, 33, whereby the axes of the magnetic poles 34, 35, in a similar manner to FIG. 7, extend horizontally or radially. In contrast to FIG. 8, the operative surfaces 62 of the magnetic selector means 32, 33 and their magnetic poles 34, 35 do not extend in FIG. 7 axially or vertically but at an angle so that they are aligned parallel to the likewise inclined edges 61 on the feet 30 of the selector elements 16 while, in FIG. 8, the corresponding edges extend axially or vertically parallel to one another. The radial position of the selector elements 16 is, in the embodiment of FIGS. 8 and 9, defined by their arms 18 which project in opposite directions and engage in the slots 15 of the pattern bar 10, in exactly the same manner as in the embodiments already described in the above.

It has been found that in the embodiment of FIG. 8, in which magnetic operative surfaces or edges are located opposite one another at a small distance from one another, it is also possible to fix the selector elements 16 in their second position, and again with a non-contact magnetic connection, which has already been explained in conjunction with the two embodiments described above. When the magnetic poles 34, 35 are controlled accordingly, the action of the magnetic selector means 32, 33 is again neutralized so that the spring 22 can move the selector element 16 back into its first position (downwards in FIG. 8).

As shown, in particular, in FIG. 9, the respective magnetic poles 34, 35 can each be provided in pairs, axially or vertically superposed.

The magnetic selector means 32, 33 are, again as in the embodiments already described, adjustable radially and, where necessary, peripherally and/or axially so that they can be adjusted relative to the feet 30 of the selector elements 16 whilst forming an air gap of any desired width between these feet and the operative surfaces of the selector means.

The present disclosure relates to the subject matter disclosed in German application No. P 42 17 419.8 of May 26, 1992, the entire specification of which is incorporated herein by reference.

What is claimed is:

1. Knitting machine comprising stitch-forming knitting needles mounted in a rotatingly driven needle cylinder, displaceable selector elements for initiating specific knitting operations, springs biasing the selector elements into a first position, mechanical control means for transferring the selector elements into a second position against the action of said biasing springs electromagnetic selector means comprising at least one activatable magnetic pole for holding the selector elements in said second positions thereof, said displaceable selector elements (16) having a stop edge (36) cooperating in the second position with a counterstop edge (37) stationary relative to the movement of the selector element, and that when the stop edge (6) engages on the counterstop edge (37) the selector elements (16) are located at such a small distance from the electromagnetic selector means (32, 33) hereby forming an air gap (38), that the magnetic force of said electromagnetic selector means is still sufficient to hold the selector elements (16) in their second position and means for adjusting the distance between the selector elements (16) and the electromagnetic selector means (32, 33).

2. Knitting machine as defined in claim 1, characterized in that the distance between the electromagnetic selector means (32, 33) and the selector element (16) in the second position is approximately 0.005 to 0.2 mm, preferably 0.01 to 0.1 mm.

3. Knitting machine as defined in claim 1, characterized in that the distance between the electromagnetic selector means (32, 33) and the selector element (16) in the second position is approximately 0.05 mm.

4. Knitting machine as defined in claim 1, characterized in that the selector elements (16) are mounted in pattern bars (10) controlled by said elements, these pattern bars adjusting the knitting needles (3) in accordance with the three-way technique into three operating positions, namely knitting, floating and tuck positions, that a first control cam (48) is provided for radially inwardly shifting the selector element (16) displaced back into said first position, thereof, together with the pattern bar (10), and triggering the floating position of the knitting needles (3), and that a second control cam (51) arranged behind the first in the direction of rotation of the needle cylinder (1) is provided for radially shifting the selector element (16) displaced back into said first position thereof, hereby taking along the pattern bar (10), and triggering the tuck position of the knitting needles.

5. Knitting machine as defined in claim 4, characterized in that the individually activatable magnetic poles (34, 35) are arranged behind one another in the direction of rotation of the needle cylinder (1).

6. Knitting machine as defined in claim 4, characterized in that a displaceable control cam part (46) is provided for transferring the selector elements (16) from said first into said second position thereof, said cam part being biased into a normal position by a spring (56).

7. Knitting machine as defined in claim 6, characterized in that the control cam part (46) is rotatably mounted and adjustable by an adjusting means (55).

8. Knitting machine as defined in claim 1, characterized in that the electromagnetic selector means (32, 33) are mounted in a guide member (39) adjustable in a cam segment (40) of the knitting machine.

9. Knitting machine as defined in claim 8, characterized in that the guide member (39) is adjustable by adjusting means (44, 45) in the cam segment (40) in two coordinate directions.

* * * * *